US005564846A

United States Patent [19]

Katsumata

[11] Patent Number: 5,564,846

[45] Date of Patent: Oct. 15, 1996

[54] PRINTER WITH SHEET POSITIONING MARKS CONTROL

[75] Inventor: Akio Katsumata, Mishima, Japan

[73] Assignee: Kabushiki Kaisha TEC, Shizuoka, Japan

[21] Appl. No.: 494,360

[22] Filed: Jun. 23, 1995

[30] Foreign Application Priority Data

Jun. 28, 1994 [JP] Japan ..... 6-145940

[51] Int. Cl.[6] ..... B41J 11/26

[52] U.S. Cl. ..... 400/611; 400/708; 101/228; 101/485; 364/478.13; 250/559.2; 250/559.26; 250/559.39; 250/559.44; 156/384

[58] Field of Search ..... 400/611, 619, 400/708, 708.1; 101/219, 224, 225, 227, 228, 288, 485; 364/471, 575; 250/559.2, 559.26, 559.39, 559.44; 156/384, 387, 540

[56] References Cited

U.S. PATENT DOCUMENTS

| | | | |
|---|---|---|---|
| Re. 28,732 | 3/1976 | von Hofe | 156/384 |
| 4,556,442 | 12/1985 | Torbeck | 101/288 |
| 4,598,780 | 7/1986 | Iwasaki et al. | 101/288 |
| 4,844,629 | 7/1989 | Hoyt | 101/288 |
| 4,998,835 | 3/1991 | Negishi et al. | 400/611 |
| 5,061,946 | 10/1991 | Helmbold et al. . | |
| 5,133,396 | 7/1992 | Selak et al. | 156/540 |
| 5,172,991 | 12/1992 | Ikeda | 400/708 |
| 5,322,380 | 6/1994 | Crocker | 400/611 |

FOREIGN PATENT DOCUMENTS 0397124 11/1990 European Pat. Off. .

OTHER PUBLICATIONS

Patent Abstracts of Japan, vol. 18, No. 366 (M-1636) Jul. 11, 1994 and JP-A-06 099 638 (Fujitsu Ltd) 12 Apr., 1994.

*Primary Examiner*—Eugene H. Eickholt
*Attorney, Agent, or Firm*—Frishauf, Holtz, Goodman, Langer & Chick

[57] ABSTRACT

The printer is provided with a detection data storage area section comprising sixteen storage areas for storing detection data from a transmission type sensor for every 1-step driving of a feed motor. When the difference between the last detection data and the detection data before steps is a value equal to or more than 0.7 V, the last detection data is set in a gap determination level storage area, is set in a gap flag area, and counting by a gap length counter is started. Thereafter, when the detection data from the transmission type sensor comes to be equal to or smaller than the value set in the gap determination level storage area is set in the gap flag area and the position in the half of the count value of the gap length counter is recognized as the gap center.

12 Claims, 9 Drawing Sheets

PRINTER WITH SHEET POSITIONING MARKS CONTROL

BACKGROUND OF THE INVENTION

1. Field of the Invention

The present invention relates to a printer which prints out characters, bar codes and the like on a paper sheet positioned at a printing position determined in accordance with a mark provided on the paper sheet or a base sheet on which the paper sheet is provided.

2. Description of the Related Art

A conventional printer, e.g., a label printer for printing characters or bar codes onto a plurality of label sheets which are adhered in predetermined intervals on the base sheet uses a transmission type sensor of optical transmission type and detects thick portions (i.e., label portions) and thin portions (i.e., gap portions) of the base sheet which are exposed between the labels, on the bases of detection levels sensed by the sensor.

In the conventional label printer, a gap between two adjacent label sheets is used as a mark for determining a printing start position of a label sheet. An output level of the transmission type sensor is detected each time one step driving motion of a stepping motor for feeding label printing sheets is performed. When a level difference between two adjacent output levels exceeds a predetermined value, it is determined that a top portion or an end portion of a label sheet is positioned in front of the transmission type sensor. According to this determination, the printing start position of the label sheet is positioned at a printing position at which a printing head is provided.

The positioning method as stated above is commonly used for a tag sheet, a label sheet and the like, whose back surface is printed with a black mark.

In this case, a reflection type sensor of an optical reflection type is used, and a non-black mark portion and a black mark portion can be recognized by the detection levels of the reflection type sensor. When the detection level varies largely at a boundary portion between a non-black mark portion and a black mark portion, it is determined that a top portion or an end portion of the black mark is sensed and the printing start position of the tag sheet or the label sheet is brought to the printing head position.

As has been explained above, since a conventional printer distinguishes a label portion and a gap portion, or a non-black mark portion and a black mark portion, a level comparison between two adjacent detection signals obtained at two steps is performed. However, the levels of the detection signals transiently or gradually varies at the boundary between a label portion and a gap portion or between a non-black mark portion and a black mark portion for several steps. Therefore, an error equivalent to several steps tends to occur when determination is made as to whether a detection position is a label portion or a mark portion, or a non-black mark portion or a black mark portion.

As a result, the top or end portions of the label sheet or those of the black mark portions cannot be detected accurately, which leads to a problem that positioning of the label printing sheets cannot be achieved at a high accuracy, thereby degrading the quality of printing, particularly, of color printing.

SUMMARY OF THE INVENTION

Hence, the present invention has an object of providing conveying apparatus capable of detecting the center of a gap portion between label sheets on a base sheet or the center of a black mark printed on a back surface of a printing sheet at a high accuracy, and a printer in which positioning of a printing sheet or an ink ribbon with respect to a printing head is achieved at a high accuracy.

According to an aspect of the invention, a conveying apparatus comprising conveying means for conveying, step by step, an object to be conveyed with a mark provided for positioning the object; a sensor for detecting the mark for positioning the object conveyed on the conveying means; and positioning means for positioning the object on the basis of the mark detected by the sensor, wherein the positioning means comprises detection level memory means for sequentially storing detection levels each obtained by the sensor for every one of minimum units by which the object to be printed is fed, step by step; a counter which starts counting when a difference between a last detection level obtained from the sensor and a preceding detection level obtained before the paper sheet is fed by a predetermined feed distance preset and stored in the detection level memory means is more than a predetermined level difference; determination level memory means for storing a detection level obtained when the counter starts counting; count stop means for making the counter stop counting when the detection level obtained from the sensor goes back to the detection level stored in the determination level memory means after the counter starts counting; and center determination means for determining a center position of the mark from a half of a count value of the counter, when the count stop means makes the counter stop counting.

According to another aspect of the invention, a printer which performs printing by feeding and positioning a printing sheet with a plurality of positioning marks formed thereon at a predetermined interval, to predetermined printing position, comprises: a counter for counting lengths of the mark as the printing sheet is fed; a sensor for detecting the marks formed on the printing sheet; detection level memory means for sequentially storing detection levels each obtained for every one of minimum units by which the printing sheet is fed, step by step; count start means for making a counter start counting when a difference between a last detection level obtained from the sensor and a preceding detection level obtained before the printing sheet is fed by a predetermined feed distance preset and stored in the detection level memory means is equal to or more than a predetermined level difference; determination level memory means for storing a last detection level when the count start means makes the counter start counting; count stop means for making the counter stop counting when the detection level obtained from the sensor goes back to the detection level stored in the determination level memory means after the counter starts counting; and center determination means for determining a position at the half of a count value of the counter, as a center of a mark, when the count stop means makes the counter stop counting.

According to this another aspect of the present invention, the detection levels are sequentially stored by the detection level memory means, for every one of minimum units by which the paper sheet is fed.

The count start means determines detection of a front end of a mark and make the counter start counting, when a difference between the last detection level generated by the sensor and a detection level obtained before the printing sheet is fed by a preset first feed distance and stored by the detection level memory means is equal to or more than a preset level difference. The last detection level is stored by the determination level memory means.

Thereafter, when the detection level obtained from the sensor goes back to the detection level stored in the detection level memory means, detection of an end of the mark is determined and counting by the counter is stopped. Then, a detection position in the half of the count value of the counter is determined as the center of the mark, by the center determination means.

Further, according to the above-mentioned another aspect of the present invention, detection levels each obtained from the sensor for every one of minimum units by which a printing sheet is fed are subjected to average processing and are sequentially stored by the detection level memory means. When a difference between a process level obtained by thus subjecting last detection levels obtained from the sensor to the average processing and a process level obtained before the printing sheet is fed by a preset feed distance and stored by the detection level memory means is equal to or more than a preset level difference, the count start means determines detection of a front end of a mark and makes the counter start counting. Accordingly, the last process level is stored.

Thereafter, when the process level obtained by thus subjecting detection levels from the sensor to an average processing goes back to the process level stored in the determination level memory means, detection of a rear end of the mark is determined and counting by the counter is stopped. Then, the center determination means determines the detection position in the half of the count value of the counter as the center.

According to still another aspect of the present invention, a printer which performs printing by feeding and positioning a printing sheet with a plurality of positioning marks formed thereon at a predetermined interval, to predetermined printing position, comprises: a counter for counting lengths of the mark as the paper sheet is fed; a sensor for detecting the marks formed on the printing sheet; detection level memory means for sequentially storing detection levels each obtained for every one of minimum units by which the printing sheet is fed, step by step; count start means for making the counter start counting when a difference between a last detection level obtained from the sensor and a preceding detection level obtained before the printing sheet is fed by a first predetermined feed distance preset and stored in the detection level memory means is equal to or more than a predetermined level difference; determination level memory means for storing a last detection level when the count start means makes the counter start counting; count stop means for making the counter stop counting when the detection level obtained from the sensor goes back to the detection level stored in the determination level memory means after the counter starts counting; center determination means for determining a position at the half of a count value, as a center of a mark, when the count stop means makes the counter stop counting; holding means for making the count stop means not stop counting before the paper sheet is fed by a preset second feed distance after the counter starts counting; invalidate means for stopping counting by the counter and invalidating the count value when a first detection level obtained from the sensor after holding by the holding means is smaller than the detection level stored in the determination level memory means.

According to this still another aspect of the present invention, the detection levels are sequentially stored by the detection level memory means, for every one of minimum units by which the printing sheet is fed.

The count start means determines detection of a front end of a mark and make the counter start counting, when a difference between the last detection level obtained from the sensor and a detection level obtained before the printing sheet is fed by a preset first feed distance and stored by the detection level memory means is equal to or more than a preset level difference. The last detection level is stored by the determination level memory means.

The holding means makes the count stop means hold not stop counting by the counter until the printing sheet is fed by a second feed distance after the counter starts counting. When the first detection level obtained from the sensor after the holding by the holding means is smaller than the detection level stored in the determination level memory means, counting by the counter is stopped by the invalidate means, and the count value is invalidated.

When the first detection level obtained from the sensor after the holding by the holding means is equal to or more than the detection level stored in the determination level memory means, detection of a rear end of the mark is determined when the detection level obtained from the sensor thereafter goes back to the detection level stored in the determination level memory means. Then, counting by the counter is stopped and the detection position in the half of the count value of the counter is determined as the center of the mark by the center determination means.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

In the following, the first embodiment of the present invention will be explained with reference to FIGS. 1 to 5 and FIG. 8.

Figure 1:
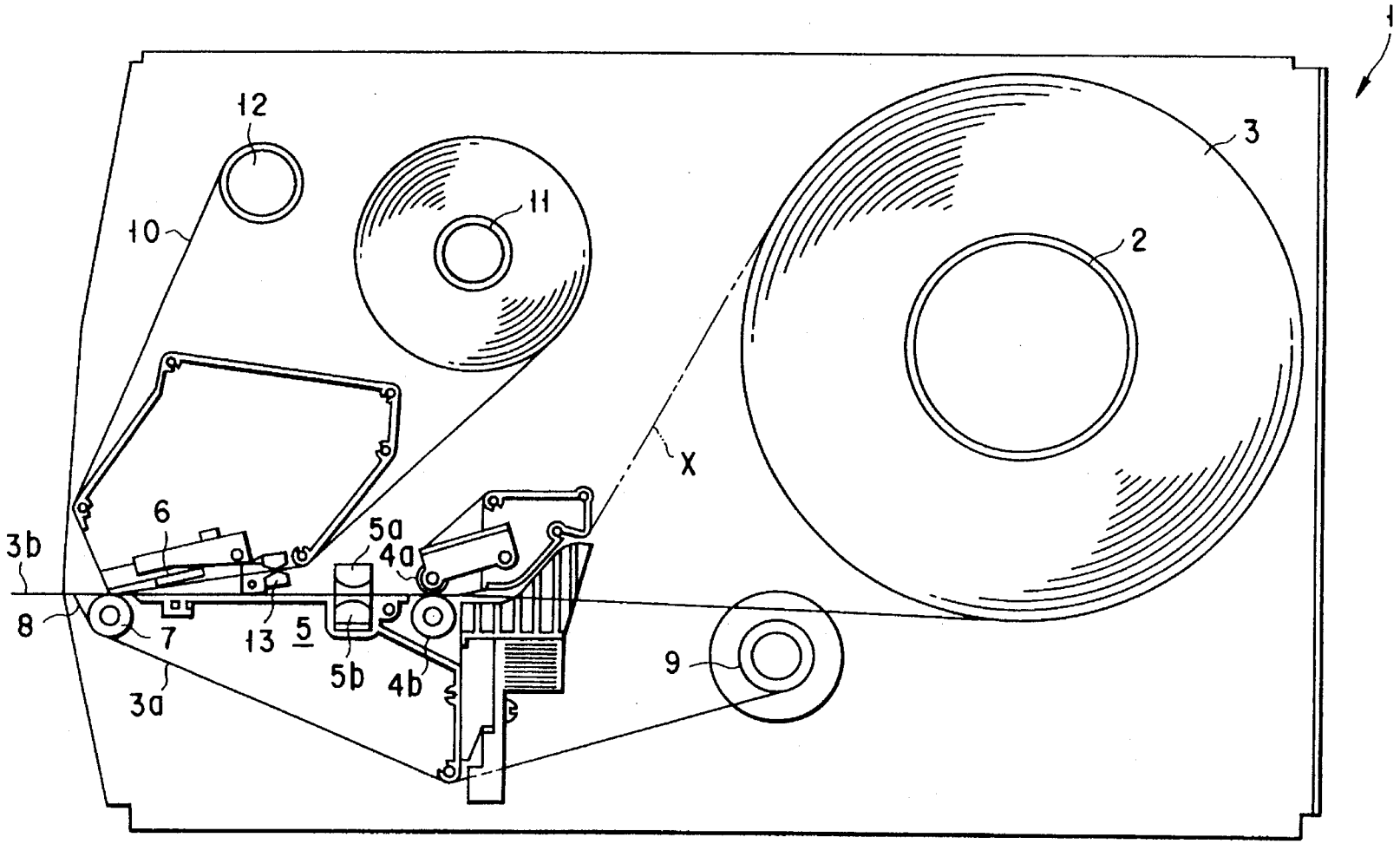
FIG. 1 shows a whole structure of a label printer according to a first embodiment of the present invention.

FIG. 1 is a diagram showing the whole structure of the label printer according to the first embodiment of the present invention. In FIG. 1, a label printing sheet 3 of a strip shaped is coiled on a label sheet holder 2 provided in a housing 1 of the label printer. The label printing sheet 3 is formed of a strip like base sheet 3*a* on which label sheets 3*b*(n−1), 3*b*(n), are adhered at a predetermined interval or gap d.

The label printing sheet 3 is took out from the holder 2 by feeding rollers 4*a* and 4*b* and fed to a thermal line head 6 via a sensor section 5. The sensor section 5 includes a reflection type sensor 5*a* and a transmission type sensor 5*b*. These sensors 5*a* and 5*b* are provided for detecting the label sheets 3*b* put on the base sheet 3 and the gap between the label sheets 3*b*, so as to position accurately the label sheets with respect to the thermal line head 6 for printing at an accurate position on the label sheets. The detailed explanation of the positioning will be described later.

The printing of the label sheet 3*b* put on the label printing sheet 3 is performed between the thermal line head 6 and a platen roller 7. After the printing is finished the label printing sheet 3 is fed to a peeling blade 8 at which the label sheet 3*b* is peeled from the base sheet 3*a*. The printed and peeled label sheets 3*b* is took out of the label printer and the base sheet 3*a* is rolled on the base sheet rolling section 9 in the housing 1.

The printing on the label sheet 3*b* can be done not only by the thermal line head 6 but also by using an ink ribbon 10. The ink ribbon 10 is fed from a ribbon feed roller 11 and rolled on the rolling roller 12. A ribbon sensor 13 is provided in the thermal line head 6 to watch a ribbon empty status of the ink ribbon 10.

The two-dashed lines X in FIG. 1 shows an alternate feeding route for taking out the label printing sheet 3 through the taking roller 4*a* and 4*b*.

Figure 2:
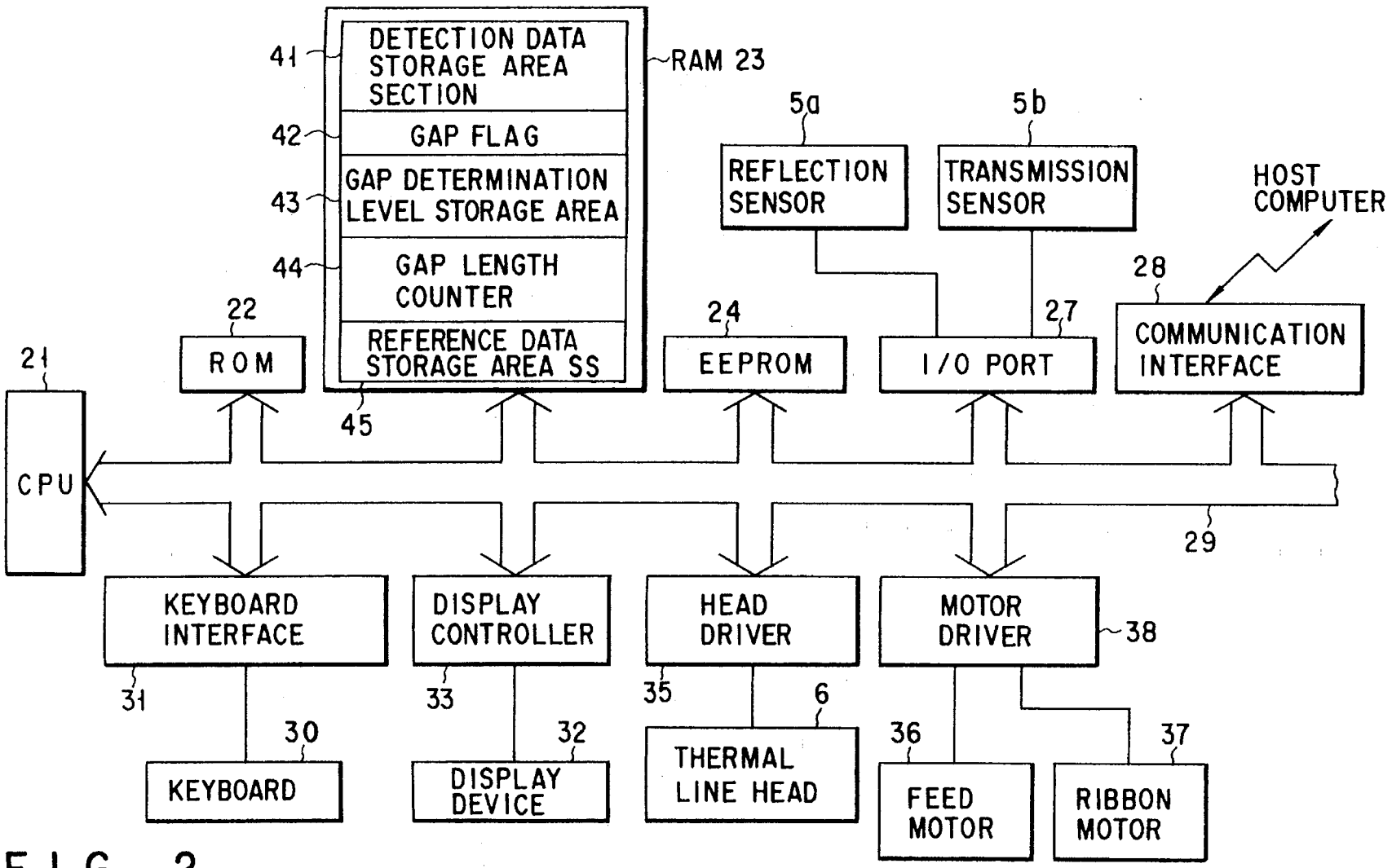
FIG. 2 is a block diagram showing a circuit configuration of the label printer according to the first embodiment of the present invention.

FIG. 2 is a block diagram showing a circuit configuration of a label printer shown in FIG. 1.

In FIG. 2, a reference numeral 21 denotes a CPU (Central Processing Unit) constituting a body of a control section for controlling the whole portions of the circuit shown in FIG. 2. The operation flow executed by the CPU 21 will be described later by referring to flow charts shown in FIGS. 5 and 14.

A ROM (Read Only Memory) 22 storing program data performed by the CPU 1, a RAM (Random Access Memory) 23 on which areas for various memories are used when CPU 21 performs its processing are formed, an EEPROM (Electrically Erasable Programmable Read Only Memory) 24 storing PLU data and the like, a reflection sensor 5*a* composed of a reflection type optical sensor for detecting presence or absence of a black mark printed on the back surface of a label printing sheet or a tag sheet and presence or absence of a printing sheet, an I/O (input/output) port 27 to which an output signal is inputted from a transmission type sensor 5*b* composed of a transmission type optical sensor for detecting a gap (mark) between label sheets on a label printing sheet, and a communication interface 28 for transmission of data with respect to a host computer (not shown) are connected to the CPU 21 through a system bus 29.

In addition, the CPU 21 is connected through the system bus 29 to a keyboard interface 31, a display controller 33 for controlling a display device 32, a head driver 35 for driving the thermal line head 6, and a motor driver 38 for driving each of a feed motor 36 as a drive source for feeding the label printing sheet or a tag sheet and a ribbon motor 37 as a drive source for feeding the ink ribbon 10. The feed motor 36 and the ribbon motor 37 may be mounted in the rolling sections 9 and 12, In the RAM 23, a detection data storage area section 41 as a detection level storage means having sixteen storage areas S(0) to S(15) (not shown), a gap flag (GF) area 42 for indicating whether or not a gap has been detected, a gap determination level storage area 43 as a determination level storage means, a gap length counter 44 as a counter for counting a gap length on the basis of gap detection through the transmission type sensor 5*b* and a reference data storage area 45 for storing reference data SS, are formed.

Further, the I/O port 27 includes an A/D (analog/digital) converter (not shown) which converts an analog signal into digital data when an output signals from the reflection type sensor 5*a* and the transmission type sensor 5*b* are analogue signals.

Figure 3:
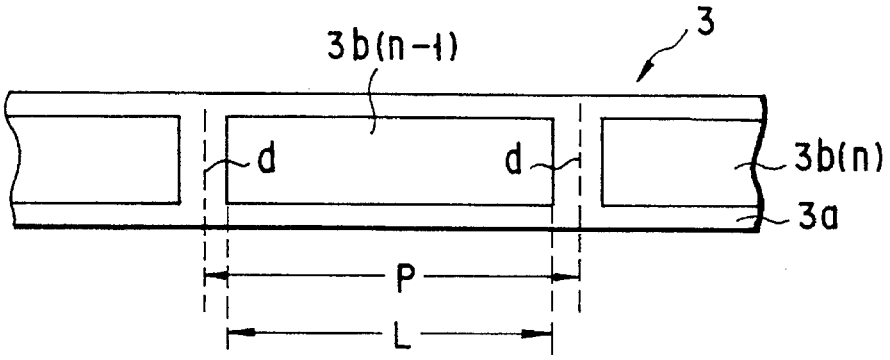
FIG. 3 is a plan view of a part of a label printing sheet used in the label printer according to the first embodiment.

Now, a relationship between the sensitivity of the transmission type sensor 5*b* and the determination of the end portions of two adjacent two label sheets 3*b*(n−1) and 3*b*(n) or the end portions of a gap d based on the detection signals obtained from the transmission type sensor 5*b* will be explained by referring to FIGS. 3 and 4.

A lamp (not shown) and the reflection type sensor 5*a* are mounted above the label printing sheet 3 on the side of which the label sheets 3*b*(n−1) and 3*b*(n) are provided. The light emitted from the lamp is detected by the transmission type sensor 5*b* put under the base sheet 3*a*. In the example shown in FIG. 3, a nominal length or a pitch of the label sheet 3*b*(n−1) is P and an effective length of the label sheet 3*b*(n−1) is L. Note that the gap d is put between the adjacent label sheets and the nominal length includes d/2 on both ends of the effective length L of each label sheet.

Figure 4:
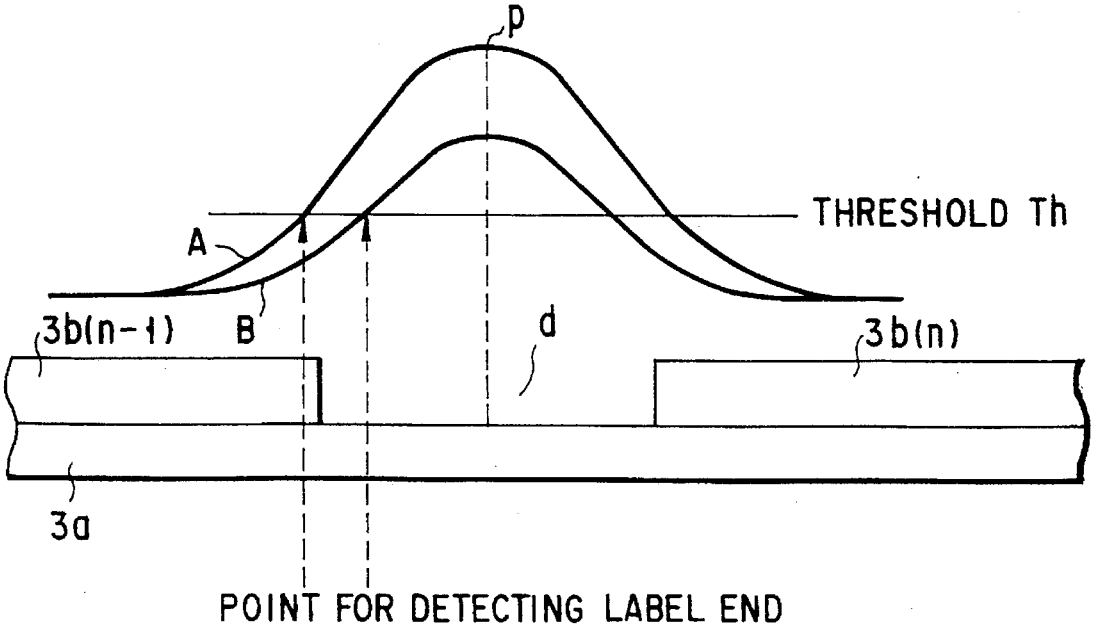
FIG. 4 is a view for showing output levels of a sensor provided in the label printer according to the first embodiment and the sensitivity of the sensor at a gap between two adjacent label sheets put on a base sheet.

When the transmission type sensor 5*b* has a high sensitivity, an output level obtained from the sensor 5*b* will have a curve A as shown in FIG. 4. Whereas, an output level obtained from the sensor 5*b* having a low sensitivity will have a curve B. When a predetermined threshold level Th is set to detect the end portions of the label sheets 3*b*(n−1) and 3*b*(n), those portions corresponding to the curves A and B above the threshold Th will represent the gap portion and the crossing points between the threshold Th and the curves A and B will represent the boundary portions between the label sheets and the gap d accurately.

However, when the sensitivity of the transmission type sensor 5*b* becomes high, the point for detecting the label end will move outside of the gap d as shown in FIG. 4, and when the sensitivity of the sensor 5*b* becomes low, the point for detecting the label end will move inside of the gap d. In both cases, an erroneous position will be detected as the top or end portion of the gap d.

As shown in FIG. 4, however, the center point p of the curve A coincides with the center point of the curve B irrespective of the sensitivity of the sensor 5*b*. Accordingly, in the present embodiment, the center point of the gap formed between two adjacent label sheets is detected and the positions of the respective label sheets are determined in accordance with the detected center point of the gap, thereby enabling the positioning of the label printing sheet with respect to the printing head accurately.

Figure 8:
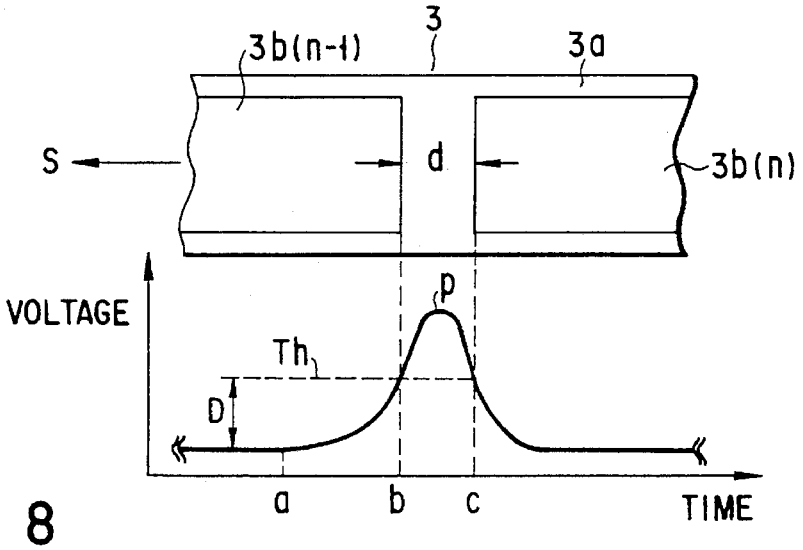
FIG. 8 shows a part of a label printing sheet used in the label printer of the first embodiment, and detection levels from the transmission type sensor where the label sheets are subjected to detection.

FIG. 8 shows an example of detection output curve of the transmission type sensor 5*b* detecting the portion of the gap d and the label printing sheet 3. Generally, the length of the gap d is very short with respect to the detection accuracy of the transmission type sensor 5*b*, the detection level of the sensor 5*b* is stable at the portion a at which the label 3*b*(n−1) is adhered and a moderate peak point p at the center of the gap portion d corresponding to the crossing points b and c with respect to the threshold Th. The level difference between the level corresponding to the stable point a and the level at the point b corresponding to the threshold Th is defined as D and the distance between the points a and b is set to correspond to 16-step conveying distance of the label printing sheet 3 by the feed motor 36.

The detection signal obtained from the transmission type sensor 5*b* is successively stored in 16 storing areas S(0) to S(15) of the detection data storage area section 41 as digital data (detection data) each time the label printing sheet 3 is fed for a predetermined length determined by one-step drive of the feed motor 36.

The difference between the newly stored detection data and the detection data preceding by 16 steps is calculated to detect whether the level difference of the points a and b is equal to or more than a value corresponding to D=0.7 V. When the level difference becomes more than D=0.7 V, a gap flag "1" is set at the flag area 42, to thereby enabling to recognize that the gap portion d has been detected. Namely, at the position b of the rear end of the label 3*b*(n−1) or the top end of the gap d or the mark as shown in FIG. 8 with respect to the conveying direction S of the label printing sheet 3, the detection level of the transmission type sensor 5*b* increases by at least D=0.7 V from the detection level at the point a preceding by 16 steps.

At this time, the gap flag area 42 is set to "1" and the gap length counter (m) 44 is reset to "0", thereby starting the counting of the gap length. The detection data of the sensor 5*b* at the position b is set at the gap determination level storage area (B) 43.

When the detection position by the transmission type sensor 5*b* reaches at a position near to the front end c of the next label 3*b*(n), the detection level lowers to the threshold Th from the peak value p. When the detection data level becomes at a level less than the value set in the gap determination level storage area (B) 43, "0" is set in the gap flag area (GF) 42, thereby enabling that the position of the sensor 5*b* is out of the detection area of the gap d. For example, the gap length between the rear end b of the preceding label 3*b*(n−1) and the front end c of the succeeding label 3*b*(n) is set to be short such as in the order of 2 mm. Since the detection condition (the brightness of the circumstances and the detection characteristic of the sensor 5*b*) in such a short length does not change, the detection level of the rear end of the succeeding label 3*b*(n) of the front end of the mark at the point c is substantial the same as the level of the detection data set in the gap determination level storage area 43 or the detection level of the rear end b of the preceding label 3*b*(n−1) or the front end of the mark.

At this time, the flag "0" is set in the gap flag area 42 and a half of the count content in the gap length counter 44 from the position b to the position c is used to determine the center of the gap.

Thus, the first embodiment is provided with a detection data storage area section 41 comprising sixteen storage areas S(0) to S(15) for storing detection data from the transmission type sensor 5*b* for detecting label adhering portions and gap portions on a label sheet, for every 1-step driving of the feed motor 36, a gap flag area 42 for determining detection of a label portion and detection of a gap portion, a gap determination level storage area (B) 43 for storing the detection level when a rear end of a label is detected, a gap length counter 44 for counting a gap length, and the reference data storage area 45 for storing the data SS. On the basis of the data stored in the detection data storage area section 41, when the difference between the last detection data from the transmission type sensor 5*b* comes to be a value equal to or more than 0.7 V, the last detection data is set in the gap determination level storage area (B) 43, 1 is simultaneously set in the gap flag 42, and the gap length counter 44 is made start counting. Thereafter, when the detection data from the transmission type sensor 5*b* comes to be a value equal to or less than a value set in the gap determination level storage area (B) 43, 0 is set in the gap flag 42, and the position in the half of the counter value counted by the gap length counter 44 is recognized as the gap center. In this manner, the center of a gap portion can be detected at a high accuracy. Therefore, a label paper sheet is positioned at a printing position of a print head at a high accuracy.

Figure 5:
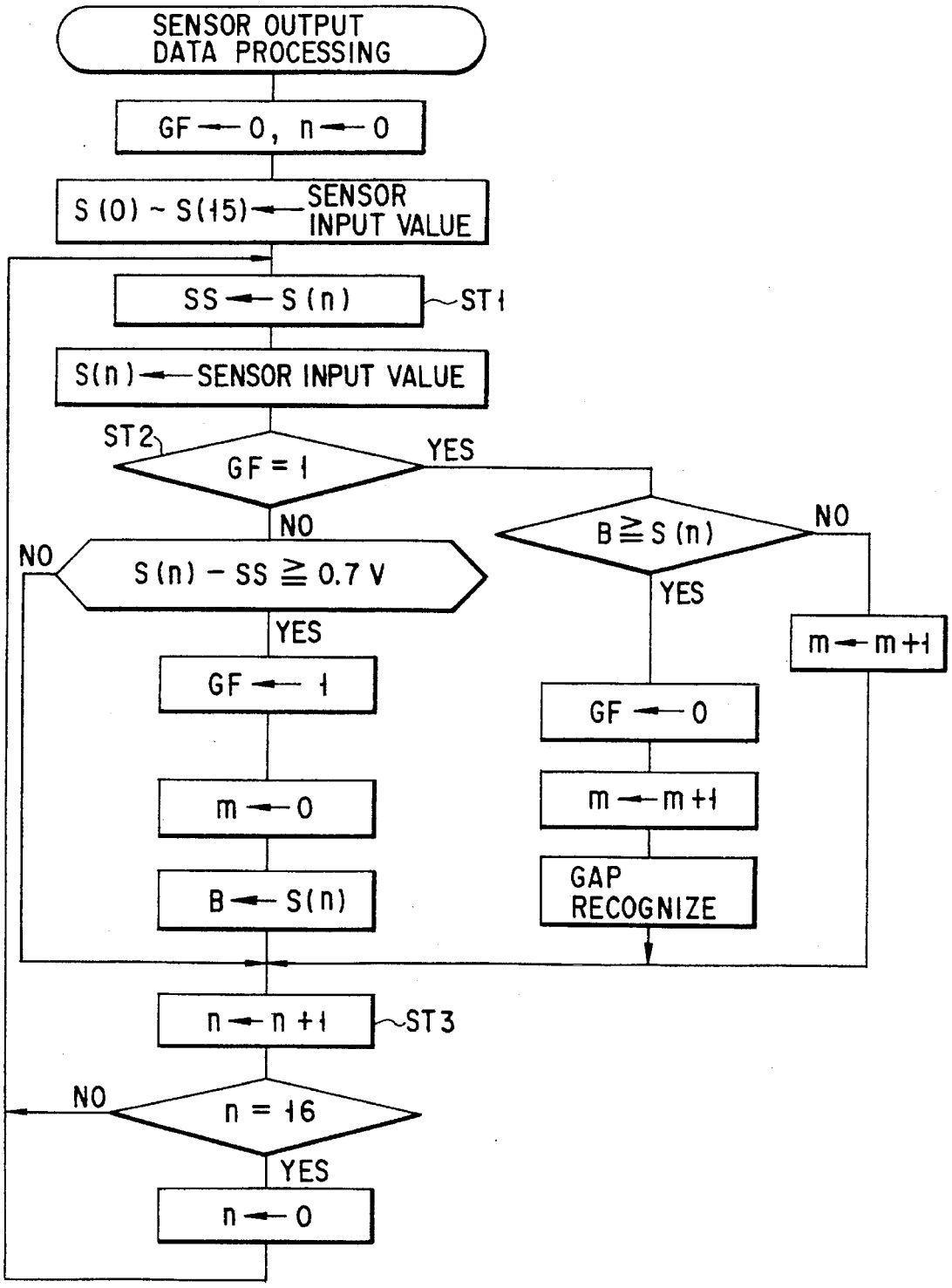
FIG. 5 shows a flow chart in which processing of the sensor output data is performed in the label printer according to the first embodiment.

FIG. 5 is a flow chart showing an operation flow of sensor output data processing performed by the CPU 21 of FIG. 2.

At first, 0 is set in the gap flag area (GF) 42, and simultaneously, 0 is also set in a specify counter n formed in the RAM 23. Digital data inputted through the I/O port 27 from the transmission type sensor 5*b* is stored into sixteen storage areas S(0) to S(15) (not shown) of the detection data storage area section 41.

At this time, from the host computer (not shown), data representing the length of the label or the pitch P and the effective length L are sent via the communication interface 28 and is stored in an area of the RAM 23. For example, the length of the label 3*b*(n−1) is set as P=100 mm, and the effective length L=98 mm. Since the difference between the lengths P and L is 2 mm, the length d/2 is set 1 mm.

In the practical label printer, 1 mm is required to bring the label printing sheet 3 at a printing speed from the stop position, and 1 mm is required to stop the traveling sheet 3. Therefore, dead length of 1 mm is required at the front and rear ends of the label 3*b*(n−1) having the effective length L. When the dead portion of 2 mm is set as the gap portion, the whole length of the label can be used effectively for the label printing. If the label printing sheet 3 is stopped at the center of the two adjacent labels, the sheet is brought to a position before the printing start position by 1 mm.

In the next, as processing in a step 1 (ST1), data stored in the storage area S(n) of the detection data storage area section 41 which corresponds to the count value n of the counter n is transferred to a reference data SS storage area 45 formed in the RAM 23, and digital data inputted through the I/O port 27 from the reflection sensor at a timing of 1-step driving of the feed motor 36 is stored into the storage area S(n), thereby to perform updating of detection data.

Upon completion of updating of the detection data, whether or not 1 is set in the gap flag (GF) area 42 is determined as processing in a step 2 (ST2).

If 1 is not set in the gap flag (GF) area 42, data SS stored in the reference data storage area 45 is subtracted from the data S(n) stored in the storage area S(n), and whether or not the subtraction result S(n)−SS is a value equal to or more than 0.7 V is determined. If the result S(n)−SS is smaller than the value equal to 0.7 V, the processing goes to a step 3 (ST3) which will be described later.

Otherwise, if the result S(n)−SS is a value equal to or more than 0.7 V, 1 is set in the gap flag (GF) area 42, 0 is set in the gap length counter (m) 44, and data of the storage area S(n) is stored in the gap determination level storage area (B) 43 formed in the RAM 23. Then, the processing goes to the step ST3.

In the processing of the step 2 stated above, if 1 is set in the gap flag (GF) area 42, determination is made as to whether or not data S(n) stored in the storage area S(n) is equal to or smaller than data B stored in the gap determination level storage area (B) 43.

If the S(n) is then equal to or smaller than B, 0 is set in the gap flag (GF) area 42, the count value of the gap length counter (m) 44 is added with +1 (by the count stop means), and the half position of the count value of the gap length counter (m) 44 is recognized as the center of a gap portion (by the center determination means). Then, the processing goes to the step ST3.

If the S(n) is then larger than B, the count value of the gap length counter (m) 44 is added with +1 and the processing goes to the step 3.

In the processing of the step 3, the count value of the specify counter n is added with +1, and whether or not the count value of the a specify counter n is equal to 16 is determined.

If the count value of the specify counter n is then not equal to 16, the processing goes again to the step 1. If the count value of the specify counter n is equal to 16, n is set to 0 and the processing goes again to the step 1.

In the first embodiment described above and in the second and third embodiments described below, it is stated that detection data is taken in from the transmission type sensor for every 1-step driving of the feed motor 36. However, this is required in those cases where a paper sheet must be positioned at the highest accuracy. As far as a sufficient accuracy can be achieved, detection data need not be taken in for every 1-step driving, but may be taken in from the sensor for every driving equivalent to 2 or more steps as a minimum unit by which a paper sheet is fed.

In addition, although the first, second, and third embodiment deal with a label sheet, the present invention is not limited to a label sheet.

For example, the present invention is applicable to a tag paper sheet on which black marks are printed at predetermined intervals. In this case, it is possible to detect the center of a black mark at a high accuracy if a reflection sensor *5a* is used and determination is made with the logic concerning the detection level being inverted.

Further, the present invention is also applicable to a paper sheet in which a notched portion (or slit) is formed at predetermined intervals. In this case, the center of a notched portion can be detected at a high accuracy with use of a transmission type sensor *5b*.

In the following, a second embodiment of the present invention will be explained with reference to FIGS. 6 and 9. In second and third embodiments, the circuit configuration of a label printer adopting the present invention is the same as that shown in FIGS. 1 and 2, but the flow of sensor output data processing performed by the CPU 21 is different therefrom. Therefore, the flow of sensor output data processing will be explained in the second and third embodiments.

Figure 6:
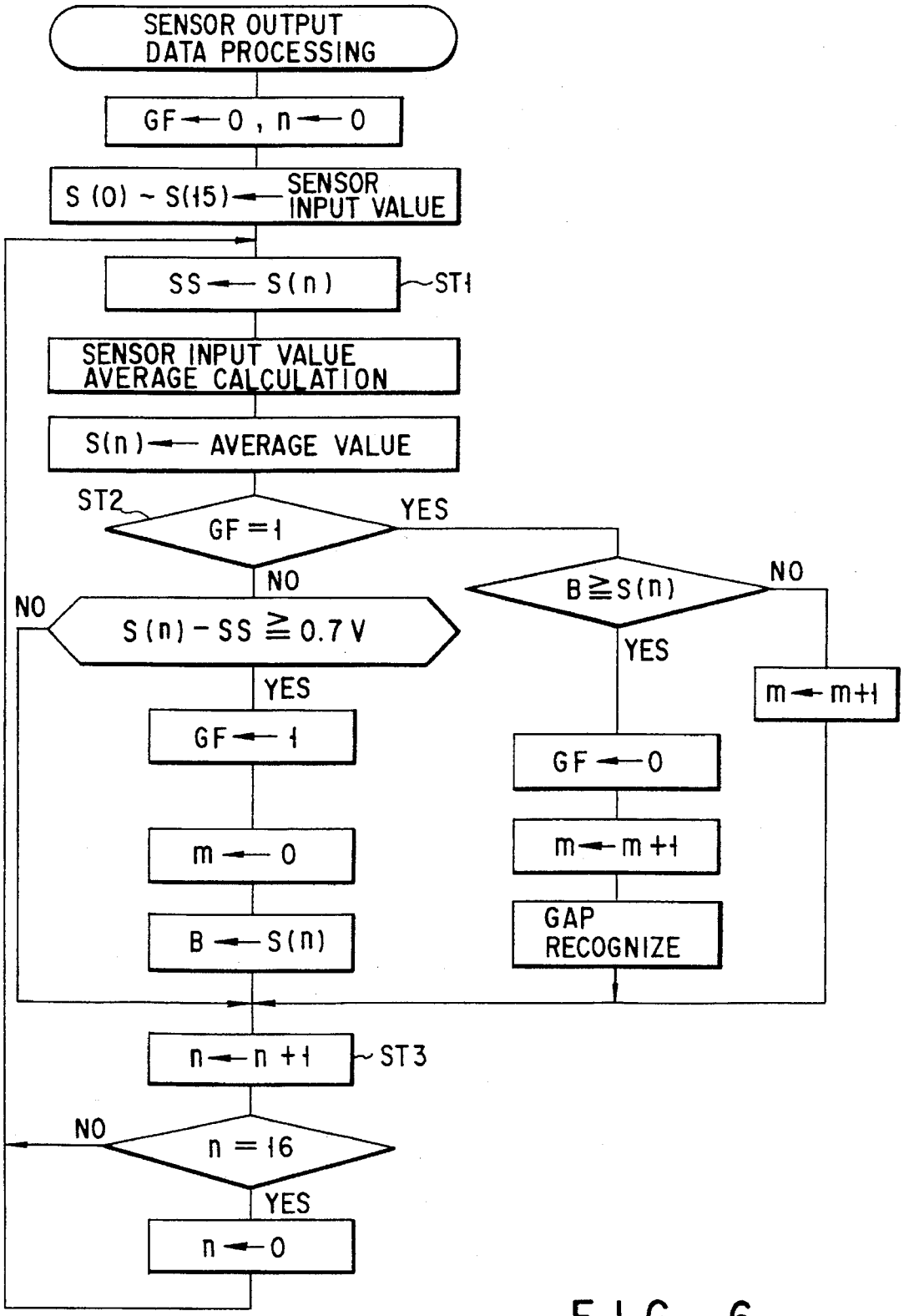
FIG. 6 shows a flow chart in which processing of the sensor output data is performed by the label printer according to a second embodiment of the present invention.

FIG. 6 is a flow chart showing the operation flow of sensor output data processing performed by the CPU 21.

At first, 0 is set in the gap flag (GF) area 42, and simultaneously, 0 is set in the specify counter n formed in the RAM 23. Digital data inputted through an I/O port 27 from the transmission type sensor *5b* is then stored into sixteen areas S(0) to S(15) of the detection data storage area section 41.

In the next, as processing in a step 1 (ST1), data stored in the storage area S(n) of the detection data storage area section 41 which corresponds to the count value n of the counter n is transferred to a reference data storage area 45 formed in the RAM 23, and an average value as detection data is calculated on the basis of digital data inputted through the I/O port 27 from the reflection sensor *5a* at a timing of 1-step driving of the feed motor 36.

The method for calculating the average value will be as follows. Foe example, on the basis of digital data (d4) inputted through the I/O port 27 from a reflection sensor *5a* and three pieces of digital data (d3, d2, and d1), an average value h of the detection data is calculated by the following equation:

$$h=\{d1+d2+d3+d4-\max(d1 \text{ to } d4)-\min(d1 \text{ to } d4)\}/2$$

The average value of detection data thus calculated is stored into a storage area S(n) and updating of the detection data is performed.

When the updating of detection data is completed, whether or not 1 is set in the gap flag (GF) area 42 is determined.

If 1 is not set in the gap flag (GF) area 42, data SS stored in the reference data storage area 45 is subtracted from the data S(n) stored in the storage area S(n), and whether or not the subtraction result S(n)−SS is a value equal to or more than 0.7 V is determined. If the result S(n)−SS is smaller than the value equal to 0.7 V, the processing goes to a step ST3 which will be described later.

Otherwise, if the result S(n)−SS is a value equal to or more than 0.7 V, 1 is set in the gap flag (GF) area 42, 0 is set in the gap length counter (m) 44, and data of the storage area S(n) is stored in the gap determination level storage area (B) 43 formed in the RAM 23. Then, the processing goes to a step ST3.

In the processing of the step 2 stated above, if 1 is set in the gap flag (GF) area 42, determination is made as to whether or not data S(n) stored in the storage area S(n) is equal to or smaller than data B stored in the gap determination level storage area (B) 43.

If the S(n) is then equal to or smaller than B, 0 is set in the gap flag (GF) area 42, the count value of the gap length counter (m) 44 is added with +1 (by the count stop means), and the half position of the count value of the gap length counter (m) 44 is recognized as the center of a gap portion (by the center determination means). Then, the processing goes to the step ST3.

If the S(n) is then larger than B, the count value of the gap length counter (m) 44 is added with +1 and the processing goes to the step ST3.

In the processing of the step ST3, the count value of the specify counter n is added with +1, and whether or not the count value of the specify counter n is equal to 16 is determined.

If the count value of the specify counter n is then not equal to 16, the processing goes again to the step ST1. If the count value of the specify counter n is equal to 16, n is set to 0 and the processing goes again to the step ST1.

Figure 9:
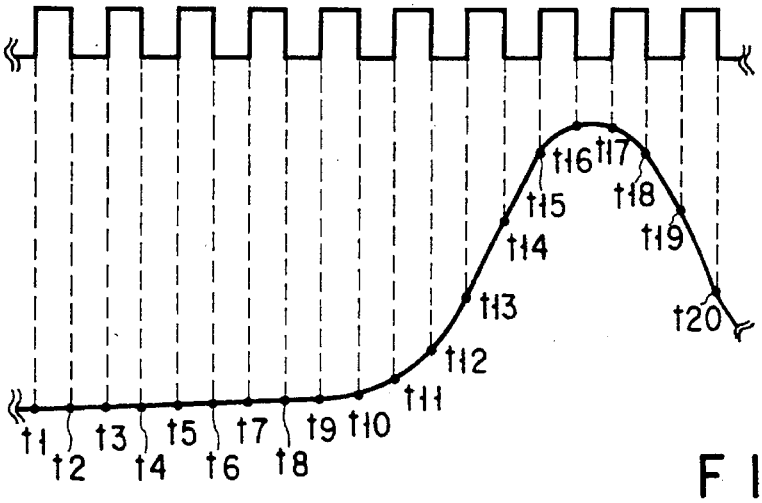
FIG. 9 shows detection levels of detection signals obtained from the transmission type sensor corresponding to drive signals supplied to a feed motor for feeding the label printing sheet in the label printer according to the second embodiment.

In the second embodiment having the above structure, data of an average value obtained by the following equations is used as detection data sequentially stored in sixteen storage areas S(0) to s(15).

Where detection levels supplied from the transmission type sensor 5*b* for every one step of driving of the feed motor 36 are t1, t2, . . . , t20, . . . , as shown in FIG. 9, and where data of average values to be then later are h1, h2, . . . H17, . . . , the following equations are satisfied.

$$h1=\{t1+t2+t3+t4-\max(t1 \text{ to } t4)-\min(t1 \text{ to } t4)\}/2$$

$$h1=\{t2+t3+t4+t5-\max(t2 \text{ to } t5)-\min(t2 \text{ to } t5)\}/2$$

$$h17=\{t17+t18+t19+t20-\max(t17 \text{ to } t20)-\min(t17 \text{ to } t20)\}/2$$

The data h1, h2, . . . , h17, . . . , of these average values are sequentially stored in the storage areas S(0) to S(15), As in the first embodiment explained above, when the difference between the data of a last average value thus calculated and the data of the average value before 16 steps comes to be a value equal to or more than 0.7 V, 1 is set in the gap flag (GF) area 42, it recognized that a gap (mark) portion goes under detection, counting is started by the gap length counter (m) 44, and data of a last average value is set in the gap determination level storage area (B) 43.

Thereafter, data of an average value comes to be a value equal to or smaller that the average value data set in the gap determination level storage area (B) 43, 0 is set in the gap flag (GF) area 42, it is recognized that the gap portion goes out of detection, and the position in the half of the count value of the gap length counter (m) 44 is recognized as the gap center.

Thus, according to the second embodiment, the same advantages and effects in the position detection as those in the first embodiment can be obtained.

Further, in this second embodiment, each detection level (or detection data) is calculated as data of an average value, and the center of a gap is detected on the basis of the data of average values. Therefore, even when instantaneous noise is included in the detection levels from the transmission type sensor 5*b*, influences from the noise can be reduced to be small so that the gap center can be detected at a higher accuracy.

Note that the method for calculating an average value explained in this second embodiment is only as an example. The present invention is not limited to this example, but may adopt another method of calculating an average value.

In the next, a third embodiment of the present invention will be explained with reference to FIGS. 7, 10, and 11.

Figure 7:
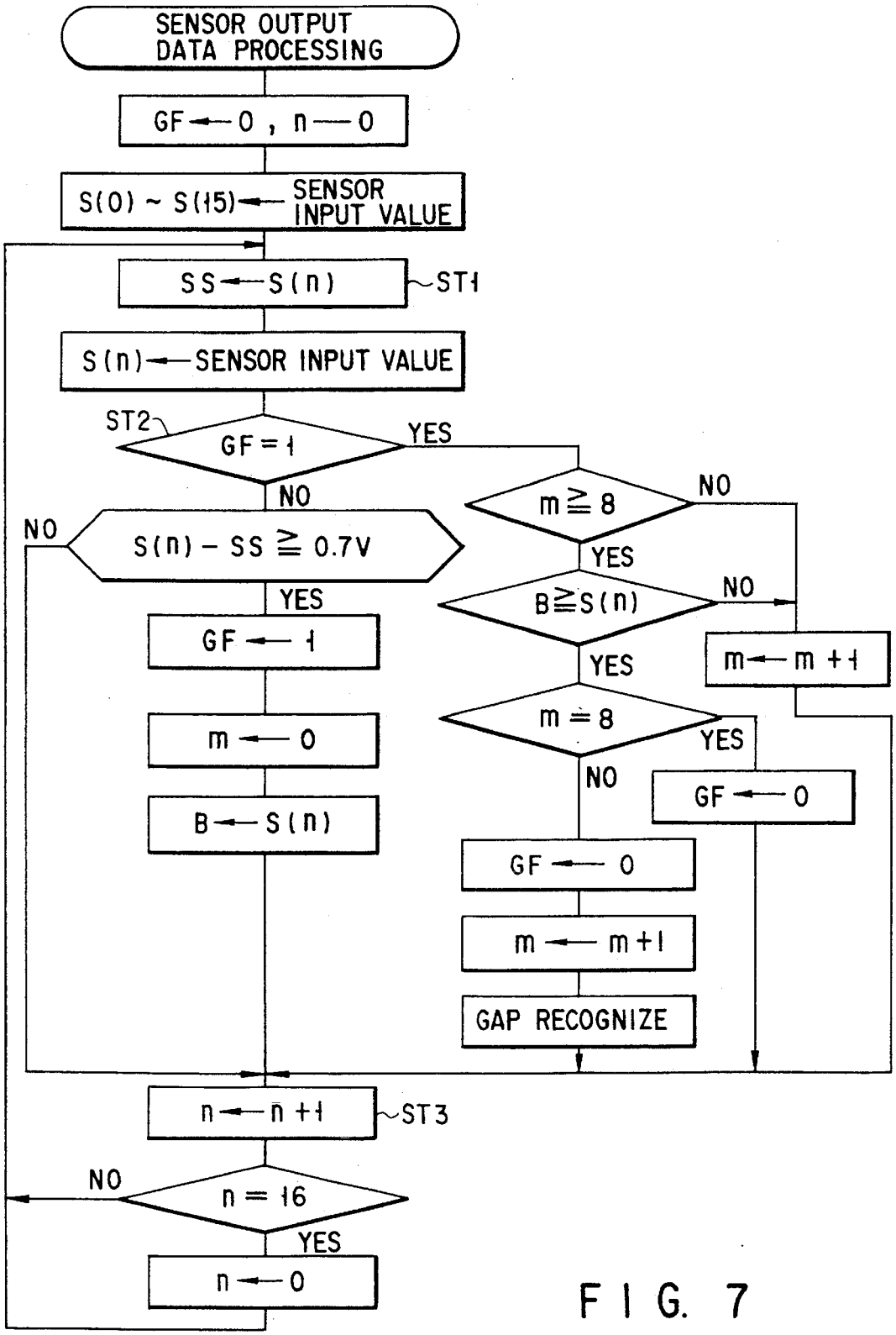
FIG. 7 shows a flow chart in which processing of the sensor output data is performed by the label printer according to a third embodiment of the present invention.

FIG. 7 is a chart showing a flow of sensor output data processing performed by the CPU 21.

At first, 0 is set in the gap flag (GF) area 42, and simultaneously, 0 is also set in a specify counter n formed in the RAM 23. Digital data inputted through the I/O port 27 from the transmission type sensor 5*b* is stored into sixteen storage areas S(0) to S(15) (not shown) of the detection data storage area section 41.

In the next, as processing in a step. 1 (ST1), data stored in the storage area S(n) of the detection data storage area section 41 which corresponds to the count value n of the counter n is transferred to a reference data storage area 45 formed in the RAM 23, and digital data inputted through the I/O port 27 from the reflection sensor 5*a* at a timing of 1-step driving of the feed motor 36 is stored into the storage area S(n), thereby to perform updating of detection data.

Upon completion of updating of the detection data, whether or not 1 is set in the gap flag (GF) area 42 is determined as processing in a step 2 (ST2).

If 1 is not set in the gap flag (GF) area 42, data SS stored in the reference data storage area 45 is subtracted from the data S(n) stored in the storage area S(n), and whether or not the subtraction result S(n)−SS is a value equal to or more than 0.7 V is determined. If the result S(n)−SS is smaller than the value equal to 0.7 V, the processing goes to a step 3 (ST3) which will be described later.

Otherwise, if the result S(n)−SS is a value equal to or more than 0.7 V, 1 is set in the gap flag (GF) area 42, 0 is set in the gap length counter (m) 44, and data of the storage area S(n) is stored in the gap determination level storage area (B) 43 formed in the RAM 23. Then, the processing goes to the step ST3.

In the processing of the step ST2 stated above, if 1 is set in the gap flag (GF) area 42, determination is made as to whether or not the count value of the gap length counter (m) 44 is 8 or more. If the count value of the gap length counter (m) 44 is smaller than 8, the count value of the gap length counter (m) 44 is added with +1, the processing goes to the step ST3 (holding means).

Otherwise, if the count value of the gap length counter (m) 44 is 8 or more, determination is made as to whether the data S(n) stored in the storage area S(n) is equal to or smaller than data B stored in the gap determination level storage area (B) 43.

If the S(n) is then larger than B, the count value of the gap length counter (m) 44 is added with +1 and the processing goes to the step ST3.

Otherwise, if the S(n) is equal to or smaller than B, determination is made as to whether or not the count value of the gap length counter (m) 44 is equal to 8.

If the count value of the gap length counter (m) 44 is equal to 8, 0 is set in the gap flag (GF) area 42, and the processing goes to the step ST3 (invalidating means).

If the count value of the gap length counter (m) 44 is not equal to 8, 0 is set in the gap flag (GF) area 42, and the count value of the gap length counter 44 is added with +1. The position in the half of the count value of the gap length counter (m) 44 is recognized as the gap center, and the processing goes to the step ST3.

In the processing of the step ST3, the count value of the specify counter n is added with +1, and whether or not the count value of the specify counter n is equal to 16 is determined.

If the count value of the specify counter n is then not equal to 16, the processing goes again to the step 1. If the count value of the specify counter n is equal to 16, n is set to 0 and the processing goes again to the step ST1.

In the third embodiment having the above structure, when the difference between the last detection data from the transmission type sensor 5b and the detection data before 16 steps comes to be a value equal to 0.7 V, 1 is set in the gap flag (GF) area 42 and it is recognized that a gap (mark) portion goes under detection. Counting is started by the gap length counter (m) 44, and the last detection data is set in the gap determination level storage area (B) 43.

Thereafter, detection data from the transmission type sensor 5b is neglected until the count value of the gap length counter (m) 44 comes to be 8. At the time point when the count value comes to be 8, determination is made as to whether the detection data from the transmission type sensor 5b at the time point is equal to or smaller than the detection data set in the gap determination level storage area (B) 43.

If the detection data obtained when the count value of the gap length counter 44 is equal to or smaller than the detection data set in the gap determination level storage area (B) 43, the detection data before 8 steps is determined as noise and is removed. The gap flag GF is then set back to 0 in the area 42, and counting by the gap length counter 44 is stopped.

Otherwise, if the detection data obtained when the count value of the gap length counter 44 is 8, the detection data before 8 steps is recognized as a rear end of a preceding label (or front end of a mark), and counting by the gap length counter 44 is continued.

Thereafter, when the detection data detected by the transmission type sensor 5b comes to be equal to or smaller than the detection data set in the gap determination level storage area (B) 43, the count value of the gap length counter 44 is greater than 8, and therefore, 0 is set in the gap flag (GF) area 42. It is recognized that the gap (or mark) portion goes out of detection, and the position in the half of the count value of the gap length counter (m) 44 is recognized as the gap center.

Figure 10:
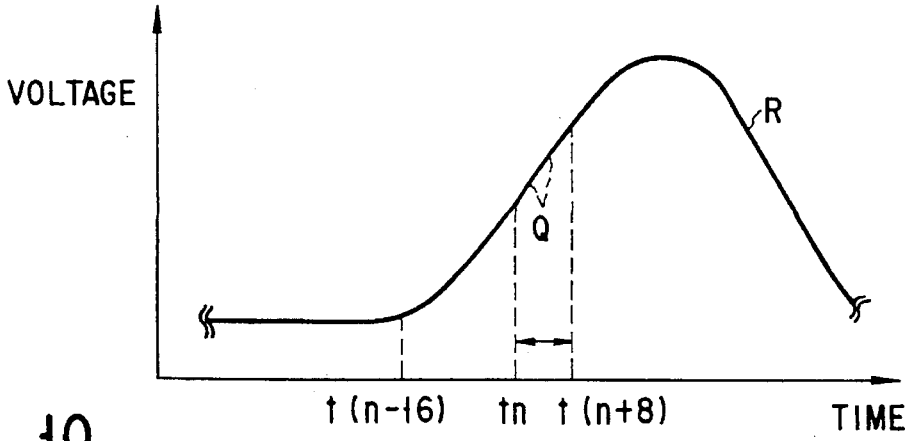
FIG. 10 shows detection levels of the transmission type sensor for explaining a method of noise reduction performed in the third embodiment of the present invention.

The following consideration will be made to a case supposing that the detection level from the transmission type sensor 5b which normally forms a continuous line R includes noise indicated by a broken line Q, as shown in FIG. 10.

The detection level (or detection data) at a position tn supplied from the transmission type sensor 5b rises from the detection level at a position t(n−16) before 16 steps by 0.7 V or more, and the detection level is determined as a rear end of a label (i.e., a front end of a mark).

If noise indicated by a broken line Q enters immediately after the position tn, the detection level of the transmission type sensor 5b once forms a peak and then falls to be under the detection level at the position tn. At the position where the detection level goes under the level at the position tn, it is determined that a front end of a next label is detected by mistake. This mistake may be effected not only by sudden noise as shown in FIG. 10 but also by a noise of high frequency component which can steadily exist.

However, in the third embodiment, since the detection level is neglected from a position tn to a position t(n+8), it is possible to reduce influences from the noise indicated by the broken line Q or the noise of high frequency component.

Figure 11:
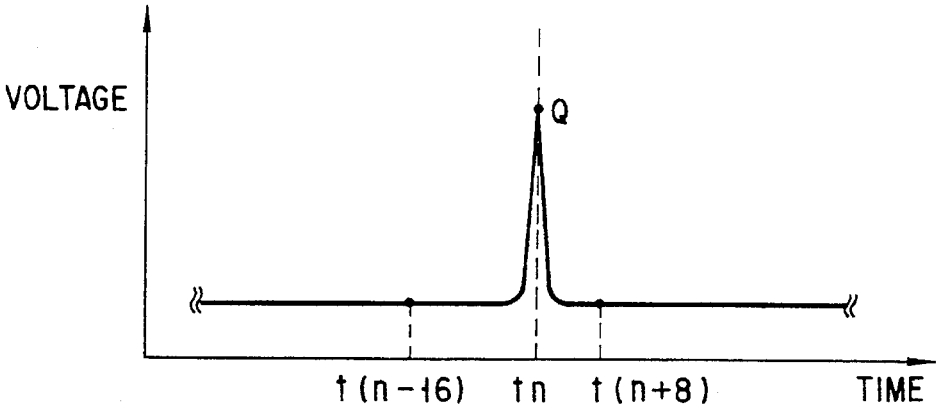
FIG. 11 shows detection levels of the transmission type sensor for explaining another method of noise reduction in the third embodiment.

In addition, consideration will be made to a case in which sudden noise Q as shown in FIG. 11 occurs at a stable portion of a label portion (where the detection level or detection data from the transmission type sensor 5b is stable at a low level).

In this case, the detection level of the transmission type sensor 5b at the position tn where noise occurs rises by 0.7 V or more from the detection level at the position t(n−16) before 16 steps, it is determined by mistake that a front end of a label is detected.

However, in this third embodiment, the detection level is neglected from the position tn to the position t(n+8), and simultaneously, 0 is set in the gap flag area 42 if the detection level of the transmission type sensor 5b at the position t(n+8) is lower than the detection level at the position tn. Counting by the gap length counter 44 is then stopped. As a result of this, error detection of a front end of a next label is canceled, so that influences from noise at a stable point on a label adhering portion can also be eliminated.

Thus, according to the third embodiment, the same advantages and effects as those in the first embodiment can be achieved.

Further, the detection level of the transmission type sensor 5b is neglected from the position at which a rear end of a label is determined as having been detected to the position coming after the paper sheet is fed by 8 steps. If the detection level after 8 steps is smaller than the detection level at the position where a rear end of a label is determined as having been detected, 0 is set in the gap flag (GF) area 42 and counting by the gap length counter 44 is stopped. Therefore, an advantage is attained in that influences from noise can be eliminated and detection of the gap center can be performed at a high accuracy.

Note that in the first, second, and third embodiments, the detection level before 16 steps as a reference to be compared with detection levels from the transmission type sensor 5b is neglected or the detection levels for eight steps from when a rear end of a label is determined as having been detected are neglected, In this respect, the numbers of steps are decided on the basis of specifications that the printer has a printing accuracy of 12 steps/mm and the gap length between labels on a used label sheet is minimum 2 mm. Therefore, the set values concerning these numbers of steps can be changed due to specifications of the printer or the likes.

Now, a method of positioning a label sheet at a print position of a printing head on the basis of detection of a gap center will be explained with reference to FIGS. 12 to 14.

When a gap center is detected (or recognized), a label printing sheet 3 is fed by preset of α steps by the feed motor 36, and the gap center (e.g., a gap center detected in past by a transmission type sensor 5b or a last detected gap center) is positioned at a print position 51 of a thermal line head 6 used as a print head.

The value of α steps is decided as follows. Where the distance between the print position 51 and the detection position of the transmission type sensor 5b is N, a reminder of N/P is α as shown in FIG. 12 when the label pitch P is smaller than the head sensor distance N. Otherwise, when the label pitch P is equal to or greater than the head sensor distance N, α=N exists.

Figure 14:
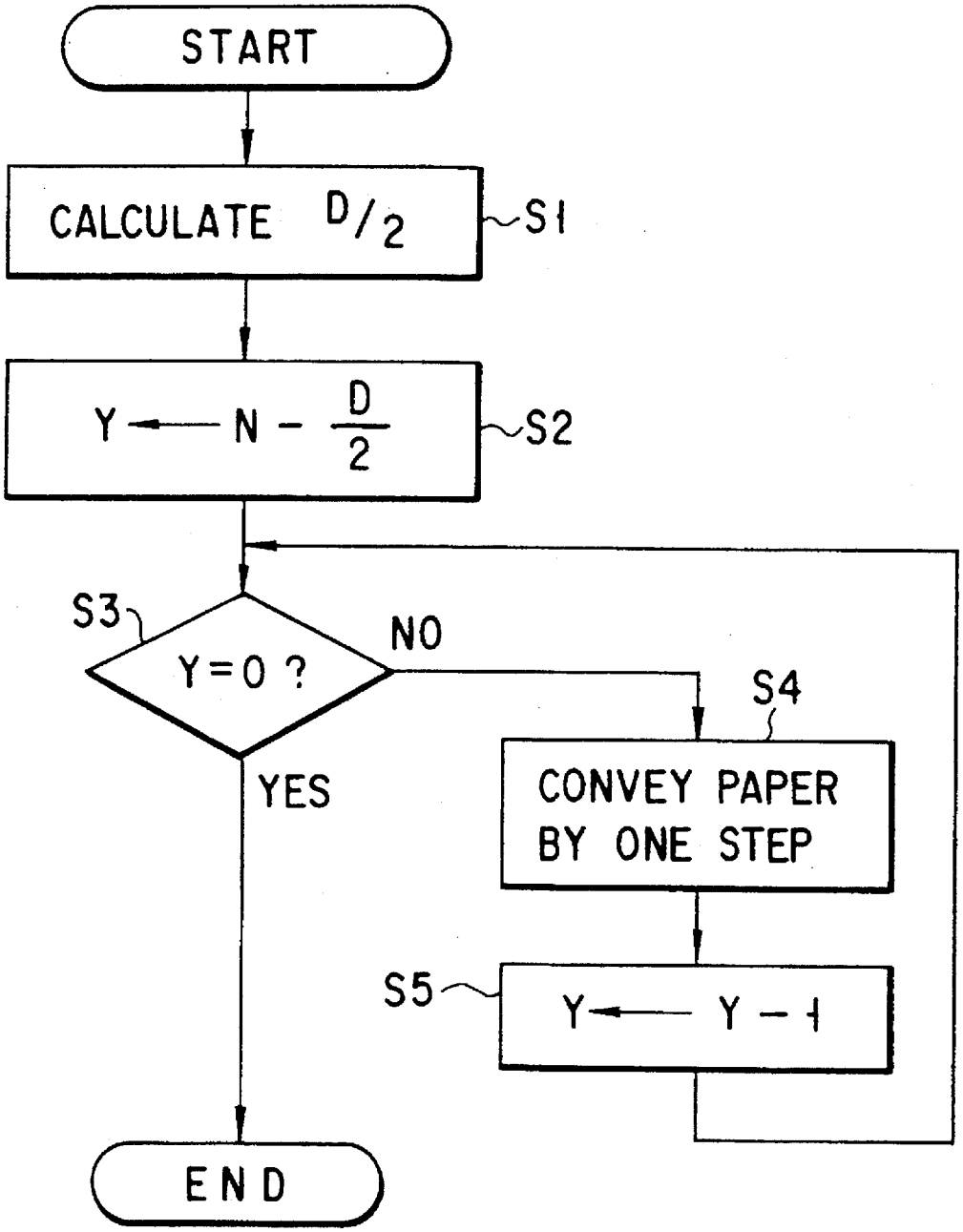
FIG. 14 is a flow chart for positioning the printing sheet at a position of a printing head based on the gap center position obtained by the embodiments of the present invention.

Now, a method for positioning the printing start position of the label sheet at the position 51 of the printing head 6 in accordance with the obtained counted value D with respect to the gap d will be describe in detail by referring to FIG. 14.

At the gap recognition step to be executed before the step ST3 in the flow chart of FIG. 5, the counted value D representing the length of the gap d is stored in the gap length counter 44 provided in the RAM 23 of FIG. 2. At this time, the sensor 5b is positioned at the point c in FIG. 8, and the gap length represented by the distance between the points a and c is denoted by the counted value D. As has been described above, even if the positions b and c do not coincide with the end portions of the gap d strictly, at least the center of the gap d will coincide with the a position corresponding to ½ of the counted value D. The counted value D can be deemed to be correct with respect to the position of the sensor 5*b*, since the sensor 5*b* is fixed in the housing 1 of the label printer. The position 51 of the thermal line head 6 is also fixed in the housing 1. Therefore, when the center position of the gap d is denoted by ½ of the counted value D, the center position of the gap d can be defined at a position shifted by D/2 to the head position 51 from the position of the sensor 5*b* in FIG. 13.

Accordingly, at the step S1 in the flow chart of FIG. 14, a half of the counted value D stored in the gap length counter 44 in RAM 23 is calculated. Then, the operation advances to the step S2 to obtain a difference value between the distance N and the value D/2. The obtained value N–D/2 is stored in a memory area (not shown) in the RAM 23 as data Y representing the distance between the center of the gap d and the head position 51.

In the next step S3, whether the data Y is zero or not is checked. In this status, the printing operation is performed on the label sheet 3*b*(n–1) of FIG. 3 by means of the head 6, under the control of the CPU 21. The CPU 21 executing the operation relating the printing process and the output data processing of the sensor section 5.

In this status, the data Y is not zero. Therefore, the process advances to step S4 where the label printing sheet 3 is shifted by one step in the direction of the head position 51. Then the process moves to the next step S5 at which a value Y–1 is set in the memory area (not shown) as updated data Y. Then, the operation returns to the step S3. The operation of steps S3 to S5 will be repeated until a value Y=0 is obtained in the step S3.

When Y=0 is detected at the step S3, it is determined that the center of the gap d has reached at the head position 51. In the example of FIG. 3, the head 6 is in the print standby status at a position advanced by 1 mm in front of the front end of the next label 3*b*(n). In this manner, the printing position of the label sheet can be set correctly on the basis of a half of the obtained count value D.

Figure 12:
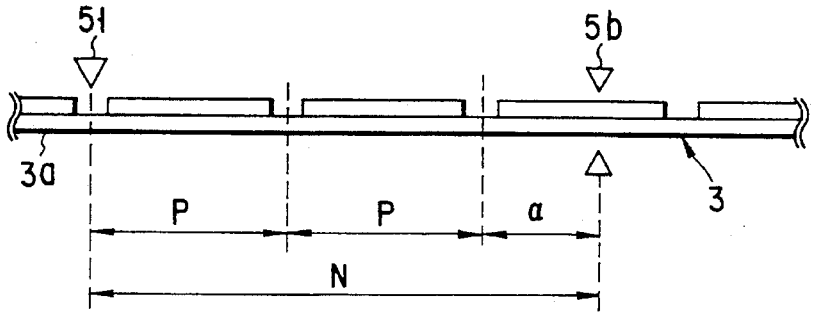
FIG. 12 shows an example of sheet positioning control based on gap center position obtained by the embodiments of the present invention.
Figure 13:
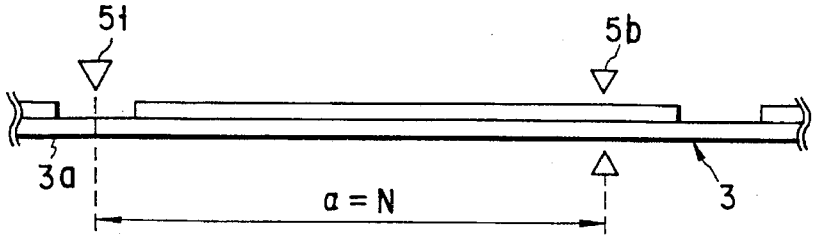
FIG. 13 shows another example of sheet positioning control based on gap center positions obtained by the embodiments of the present invention.

There is a case wherein short label sheets are used so that several label sheets appear between the sensor 5*b* and the head position 51 as shown in FIG. 12. Even in such a case, the distance N between the sensor 5*b* and the head position 51, the length of the label and the gap length are known strictly, the positioning of the label sheet with respect to the head position 51 can be done very accurately.

The described embodiments are directed to the case wherein the present invention is applied to the label printer capable of positioning the label sheet at a printing start position accurately. The present invention is not limited to this case, and can be applied to a case where positions of color ribbons such as yellow ribbon, cyan ribbon and magenta ribbon are determined correctly in a color printer.

As has been specifically described above, according to the present invention, it is possible to provide a conveying apparatus and a printer by which the position of an object to be conveyed such as a center of a gap portion between labels on a label sheet or the center of a black mark printed on a back surface of a printing sheet can be detected at a high accuracy so that positioning of the printing sheet can be achieved at a high accuracy.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A conveying apparatus comprising:

conveying means for conveying, step by step, an object to be conveyed with a mark provided for positioning the object;

a sensor for detecting the mark for positioning the object conveyed on the conveying means; and positioning means for positioning the object on the basis of the mark detected by the sensor;

wherein the positioning means comprises:

detection level memory means for sequentially storing detection levels each obtained by the sensor for every one of minimum units by which the object to be printed is fed, step by step;

a counter which starts counting when a difference between a last detection level obtained from the sensor and a preceding detection level obtained before the paper sheet is fed by a predetermined feed distance preset and stored in the detection level memory means is more than a predetermined level difference;

determination level memory means for storing a detection level obtained when the counter starts counting;

count stop means for making the counter stop counting when the detection level obtained from the sensor goes back to the detection level stored in the determination level memory means after the counter starts counting; and center determination means for determining a center position of the mark from a half of a count value of the counter, when the count stop means makes the counter stop counting.

2. A printer which performs printing by feeding and positioning a printing sheet with a plurality of positioning marks formed thereon at a predetermined interval, to a predetermined printing position, the printer comprising:

a counter for counting lengths of the marks as the printing sheet is fed;

a sensor for detecting the marks formed on the printing sheet;

detection level memory means for sequentially storing detection levels each obtained for every one of minimum units by which the printing sheet is fed, step by step;

count start means for making a counter start counting when a difference between a last detection level obtained from the sensor and a preceding detection level obtained before the printing sheet is fed by a predetermined feed distance preset and stored in the detection level memory means is equal to or more than a predetermined level difference;

determination level memory means for storing a last detection level when the count start means makes the counter start counting;

count stop means for making the counter stop counting when the detection level obtained from the sensor goes back to the detection level stored in the determination level memory means after the counter starts counting; and center determination means for determining a position at the half of a count value of the counter, as a center of a mark, when the count stop means makes the counter stop counting.

3. A printer according to claim 2, wherein said detection level memory means includes means for subjecting the detection levels each obtained from the sensor for every one of minimum units by which a printing sheet is fed, to average processing to sequentially store into the detection level memory means.

4. A printer which performs printing by feeding and positioning a printing sheet with a plurality of positioning marks formed thereon at a predetermined interval, to a predetermined printing position, the printer comprising:

a counter for counting lengths of the marks as the paper sheet is fed;

a sensor for detecting the marks formed on the printing sheet;

detection level memory means for sequentially storing detection levels each obtained for every one of minimum units by which the printing sheet is fed, step by step;

count start means for making the counter start counting when a difference between a last detection level obtained from the sensor and a preceding detection level obtained before the printing sheet is fed by a first predetermined feed distance preset and stored in the detection level memory means is equal to or more than a predetermined level difference;

determination level memory means for storing a last detection level when the count start means makes the counter start counting;

count stop means for making the counter stop counting when the detection level obtained from the sensor goes back to the detection level stored in the determination level memory means after the counter starts counting;

center determination means for determining a position at the half of a count value, as a center of a mark, when the count stop means makes the counter stop counting;

holding means for making the count stop means not stop counting before the paper sheet is fed by a preset second feed distance after the counter starts counting; and invalidate means for stopping counting by the counter and invalidating the count value when a first detection level obtained from the sensor after holding by the holding means is smaller than the detection level stored in the determination level memory means.

5. A conveying apparatus comprising:

conveying means for conveying, step by step, an object to be conveyed with a mark provided for positioning the object;

a sensor for detecting the mark for positioning the object conveyed on the conveying means; and positioning means for positioning the object on the basis of the mark detected by the sensor;

wherein said sensor includes generating means for generating a detection signal for detecting said mark every time said object is conveyed on the conveying means for a predetermined unit distance; and wherein said positioning means comprises:

means for storing a reference signal used to detect said mark;

means for obtaining a difference value between the detection signal and the reference signal;

a counter which starts counting when said difference value reaches at a predetermined value;

count stop means for making the counter stop counting when a level of said detection signal obtained from the sensor goes back to the detection level at which said counter starts after the counter starts counting; and determination means for determining a portion of the object to be conveyed which passes in front of said sensor until said counter is stopped from the start of the counter as said mark.

6. A conveying apparatus according to claim 5, wherein said count stop means comprises:

means for storing the detection signal obtained when the difference between the detection signal and the reference signal reaches at the predetermined value as a mark signal; and means for outputting a stopping signal of said counter when the detection signal becomes less than the mark signal.

7. A conveying apparatus according to claim 5, wherein said reference signal storing means for detecting said mark includes reference signal storage means for storing the detection signal of the sensor as said reference signal.

8. A conveying apparatus according to claim 7, wherein said detecting means comprises:

a conveyance distance detection counter which is set at a time when said detection signal is stored in said reference signal storage means and which is reset when the object is conveyed for a predetermined distance; and means for starting said counter when said conveyance distance detection counter is reset and when the difference value reaches the predetermined value.

9. A conveying apparatus according to claim 5, wherein said generating means includes means for obtaining an average value of levels of the detection signals obtained from the sensor to output a resultant average signal as the detection signal.

10. A conveying apparatus according to claim 5, wherein said object positioning means includes:

means for obtaining a half value of the counted value in the counter stopped by said count stop means; and means for determining the position of a mark of the object positioned in front of said sensor in accordance with the half value.

11. A conveying apparatus according to claim 6, wherein the apparatus further comprises:

holding means for holding a count stopping status of said counter by said count stop means until said object is conveyed for a predetermined distance after the count of the counter is started; and means for canceling the count stop status to restore the counting operation of the counter when a level of a first detection signal obtained from the sensor after the holding is performed by said holding means is less than a level of the detection signal stored in said mark signal storage means.

12. A printing method for performing printing by feeding and positioning a printing sheet with a plurality of positioning marks formed thereon at a predetermined interval, to a predetermined printing position, the method comprising the steps of:

counting lengths of the marks as the printing sheet is fed using a count start means to start a counter;

detecting the marks formed on the printing sheet using a sensor;

sequentially storing detection levels each obtained for every one of minimum units by which the printing sheet is fed in a detection level memory means, step by step;

starting the counting operation when a difference between a last detection level obtained from the sensor and a preceding detection level obtained before the printing sheet is fed by a predetermined feed distance preset and stored in the detection level memory means is equal to or more than a predetermined level difference;

storing a last detection level when the count start means makes the counter start counting;

stopping the counting operation when the detection level obtained from the sensor goes back to the detection level stored in the determination level memory means after the counter starts counting; and determining a position at the half of a count value of the counter, as a center of a mark, when the counting operation is stopped.

* * * * *